US006072439A

United States Patent [19]

Ippolito et al.

[11] Patent Number: 6,072,439

[45] Date of Patent: Jun. 6, 2000

[54] BASE STATION ANTENNA FOR DUAL POLARIZATION

[75] Inventors: Joseph R. Ippolito, Batavia; Henry Villegas, Oak Forest; John S. Wilson, Downers Grove, all of Ill.

[73] Assignee: Andrew Corporation, Orland Park, Ill.

[21] Appl. No.: 09/007,648

[22] Filed: Jan. 15, 1998

[51] Int. Cl.[7] ..... H01Q 21/26

[52] U.S. Cl. ..... 343/797; 343/795; 343/821

[58] Field of Search ..... 343/795, 797, 343/820, 821, 853, 872, 789, 815, 817, 818, 819

[56] References Cited

U.S. PATENT DOCUMENTS

| | | | |
|---|---|---|---|
| H001460 | 7/1995 | Air Force | 343/700 MS |
| 2,130,033 | 9/1938 | Scharlau . | |
| 2,455,403 | 12/1948 | Brown . | |
| 3,482,253 | 12/1969 | Zucconi . | |
| 3,496,570 | 2/1970 | Lewis . | |
| 3,680,139 | 7/1972 | Reynolds, Jr. | 343/756 |
| 3,680,143 | 7/1972 | Ajioka et al. | 343/778 |
| 3,681,769 | 8/1972 | Perrotti et al. | 343/814 |
| 3,681,771 | 8/1972 | Lewis | 343/817 |
| 3,701,157 | 10/1972 | Uhrig | 343/797 |
| 3,718,935 | 2/1973 | Ranghelli et al. . | |
| 3,720,953 | 3/1973 | Ajioka | 343/797 |
| 3,742,506 | 6/1973 | Wilkinson | 343/771 |
| 3,747,114 | 7/1973 | Shyhalla | 343/853 |
| 3,750,185 | 7/1973 | Evans | 343/814 |
| 3,810,185 | 5/1974 | Wilkinson | 343/756 |
| 3,821,742 | 6/1974 | Pollard | 343/727 |
| 3,922,680 | 11/1975 | Alsberg et al. | 343/754 |
| 4,015,263 | 3/1977 | Koerner et al. | 343/708 |
| 4,031,537 | 6/1977 | Alford | 343/704 |
| 4,087,818 | 5/1978 | Sanford . | |
| 4,180,817 | 12/1979 | Sanford | 343/700 MS |
| 4,193,077 | 3/1980 | Greenberg et al. | 343/747 |
| 4,198,641 | 4/1980 | Gibson | 343/797 |
| 4,223,317 | 9/1980 | Rod | 343/803 |
| 4,263,598 | 4/1981 | Bellee et al. | 343/700 MS |
| 4,340,891 | 7/1982 | Phillips | 343/713 |
| 4,364,050 | 12/1982 | Lopez | 343/700 MS |
| 4,412,222 | 10/1983 | Mohring et al. | 343/779 |
| 4,464,663 | 8/1984 | Lalezari et al. | 343/700 MS |
| 4,472,717 | 9/1984 | Eaves et al. | 343/5 |
| 4,504,836 | 3/1985 | Seavey . | |
| 4,513,292 | 4/1985 | Bowman | 343/821 |
| 4,518,969 | 5/1985 | Bogner | 343/819 |
| 4,571,591 | 2/1986 | Valentino et al. | 343/754 |
| 4,644,562 | 2/1987 | Kavehrad et al. | 375/14 |

(List continued on next page.)

FOREIGN PATENT DOCUMENTS

| | | |
|---|---|---|
| 952 7118 | 2/1986 | Australia . |
| 922 8386 | 5/1993 | Australia . |
| 0 416 300 | 3/1991 | European Pat. Off. . |

(List continued on next page.)

OTHER PUBLICATIONS

Brian Edward and Daniel Rees, "A Broadband Printed Dipole With Integrated Balun" Microwave Journal May 1987 (pp. 339–344).

*Primary Examiner*—Don Wong
*Assistant Examiner*—Tan Ho
*Attorney, Agent, or Firm*—Jenkens & Gilchrist

[57] ABSTRACT

An improved antenna system for transmitting and receiving electromagnetic signals comprising a backplane having a length and a vertical axis along the length. A plurality of dipole radiating elements project outwardly from a surface of the backplane. Each of the elements includes a balanced orthogonal pair of dipoles aligned at first and second predetermined angles with respect to the vertical axis, forming crossed dipole pairs. An unbalanced feed network extends along the backplane and connected to the radiating elements. A printed circuit board balun is attached to each of the dipoles. The antenna can also include a parasitic element positioned along the vertical axis such that primary electromagnetic fields induce currents on the parasitic element, these induced currents re-radiate secondary electromagnetic fields which cancel portions of the primary electromagnetic fields, thereby improving isolation.

63 Claims, 12 Drawing Sheets

U.S. PATENT DOCUMENTS

| | | | |
|---|---|---|---|
| 4,647,942 | 3/1987 | Counselman, III et al. | 343/797 |
| 4,658,262 | 4/1987 | DuHamel | 343/792.5 |
| 4,675,685 | 6/1987 | Finken | 343/708 |
| 4,695,844 | 9/1987 | Houchangnia | 343/781 CA |
| 4,710,775 | 12/1987 | Coe | 343/727 |
| 4,737,793 | 4/1988 | Munson et al. | 342/361 |
| 4,772,891 | 9/1988 | Svy | 343/707 |
| 4,821,039 | 4/1989 | Crane | 342/153 |
| 4,825,220 | 4/1989 | Edward et al. | 343/795 |
| 4,839,663 | 6/1989 | Kurtz | 343/771 |
| 4,870,426 | 9/1989 | Lamberty . | |
| 4,929,961 | 5/1990 | Nakase | 343/715 |
| 4,943,811 | 7/1990 | Alden et al. | 343/814 |
| 5,146,234 | 9/1992 | Lalezari | 343/895 |
| 5,157,409 | 10/1992 | Hamin . | |
| 5,172,080 | 12/1992 | Fisher et al. . | |
| 5,206,655 | 4/1993 | Caille et al. | 343/700 MS |
| 5,220,330 | 6/1993 | Salvail et al. | 342/62 |
| 5,227,807 | 7/1993 | Bohlman | 343/895 |
| 5,268,701 | 12/1993 | Smith | 343/767 |
| 5,274,391 | 12/1993 | Connolly | 343/820 |
| 5,309,165 | 5/1994 | Segal et al. | 343/770 |
| 5,319,379 | 6/1994 | Waken et al. | 343/756 |
| 5,321,414 | 6/1994 | Alden et al. | 343/816 |
| 5,400,042 | 3/1995 | Tulinsteff | 343/727 |
| 5,451,969 | 9/1995 | Toth et al. | 343/781 CA |
| 5,453,751 | 9/1995 | Tsukamoto et al. | 343/700 MS |
| 5,481,272 | 1/1996 | Yarsunas | 343/797 |
| 5,499,033 | 3/1996 | Smith | 343/700 MS |
| 5,534,877 | 7/1996 | Sorbello et al. | 343/700 MS |
| 5,589,843 | 12/1996 | Arnold et al. . | |
| 5,629,713 | 5/1997 | Mailandt et al. | 343/808 |
| 5,630,226 | 5/1997 | Naoki et al. . | |
| 5,818,397 | 10/1998 | Yarsunas et al. | 343/797 |
| 5,874,924 | 2/1999 | Csongor et al. | 343/797 |

FOREIGN PATENT DOCUMENTS

| | | |
|---|---|---|
| 0 464 255 | 1/1992 | European Pat. Off. . |
| 0 523 770 | 6/1992 | European Pat. Off. . |
| 0 566 522 A1 | 4/1993 | European Pat. Off. . |
| 0 725 498 | 12/1994 | European Pat. Off. . |
| 0 647 977 | 4/1995 | European Pat. Off. . |
| 0 657956 | 6/1995 | European Pat. Off. . |
| 0 495 507 | 11/1995 | European Pat. Off. . |
| 0 715 477 | 6/1996 | European Pat. Off. . |
| 0 433 255 | 1/1997 | European Pat. Off. . |
| 1236535 | 6/1959 | France . |
| 2048571 | 12/1980 | United Kingdom . |
| 2191043 | 12/1987 | United Kingdom . |

BASE STATION ANTENNA FOR DUAL POLARIZATION

FIELD OF THE INVENTION

The present invention relates generally to the field of antennas. More particularly, it concerns a dual polarized base station antenna for wireless telecommunication systems.

BACKGROUND OF THE INVENTION

Base stations used in wireless telecommunication systems have the capability to receive linear polarized electromagnetic signals. These signals are then processed by a receiver at the base station and fed into the telephone network. In practice, the same antenna which receives the signals can also be used to transmit signals. Typically, the transmitted signals are at different frequencies than the received signals.

A wireless telecommunication system suffers from the problem of multi-path fading. Diversity reception is often used to overcome the problem of severe multi-path fading. A diversity technique requires at least two signal paths that carry the same information but have uncorrelated multi-path fadings. Several types of diversity reception are used at base stations in the telecommunications industry including space diversity, direction diversity, polarization diversity, frequency diversity and time diversity. A space diversity system receives signals from different points in space requiring two antennas separated by a significant distance. Polarization diversity uses orthogonal polarization to provide uncorrelated paths.

As is well-known in the art, the sense or direction of linear polarization of an antenna is measured from a fixed axis and can vary, depending upon system requirements. In particular, the sense of polarization can range from vertical polarization (0 degrees) to horizontal polarization (90 degrees). Currently, the most prevalent types of linear polarization used in systems are those which use vertical/horizontal and +45°/−45° polarization (slant 45°). However, other angles of polarization can be used. If an antenna receives or transmits signals of two polarizations normally orthogonal, they are also known as dual polarized antennas.

An array of slant 45° polarized radiating elements is constructed using a linear or planar array of crossed dipoles located above a ground plane. A crossed dipole is a pair of dipoles whose centers are co-located and whose axes are orthogonal. The axes of the dipoles are arranged such that they are parallel with the polarization sense required. In other words, the axis of each of the dipoles is positioned at some angle with respect to the vertical axis of the antenna array.

One problem associated with a crossed dipole configuration is the interaction of the electromagnetic field of each crossed dipole with the fields of the other crossed dipoles and the surrounding structures which support, house and feed the crossed dipoles. As is well known in the art, the radiated electromagnetic fields surrounding the dipoles transfer energy to each other. This mutual coupling influences the correlation of the two orthogonally polarized signals. The opposite of coupling is isolation, i.e., coupling of −30 dB is equivalent to 30 dB isolation. Dual polarized antennas have to meet a certain port-to-port isolation specification. The typical port-to-port isolation specification is 30 dB or more. The present invention provides a means to increase the port-to-port isolation of dual polarized antenna systems with a simple parasitic element positioned transverse to a vertical axis of the backplane approximately midway along the length of the backplane. The present invention further provides a means to improve the port-to-port isolation and cross polarization of dual polarized antenna systems with a simple plate, having generally square apertures, that is displaced above a top side of the backplane. In both the parasitic element and the square aperture plate embodiment, the isolation results from the phase-adjusted re-radiated energy that cancels with the dipole mutual coupling energy.

Generally, dual polarized antennas must meet the 30 dB isolation specification in order to be marketable. Not meeting the specification means the system integrator might have to use higher performance filters which cost more and decrease antenna gain. The present invention overcomes these concerns because it meets or exceeds the 30 dB isolation specification.

Another problem with prior antennas is the attachment of the protective radome to the backplane of the antenna. Because of the manner of attachment of prior radomes, prior radome designs have allowed water and other environmental elements to enter the antenna, thereby contributing to corrosion of the antenna. Furthermore, because those prior radomes are loose and not tightly secured to the backplane, such radomes allow the radome to move with respect to the backplane thus allowing wind and water to enter the antenna.

Moreover, the visual impact of base station towers on communities has become a societal concern. It has become desirable to reduce the size of these towers and thereby lessen the visual impact of the towers on the community. The size of the towers can be reduced by using base station towers with fewer antennas. This can be achieved if dual polarized antennas and polarization diversity are used. Such systems replace systems using space diversity which requires pairs of vertically polarized antennas. Some studies indicate that, for urban environments, polarization diversity provides signal quality equivalent to space diversity. With the majority of base station sites located in urban environments, it is likely that dual polarized antennas will be used in place of the conventional pairs of vertically polarized antennas.

SUMMARY OF THE INVENTION

It is a principal object of the present invention to provide an antenna array which produces dual polarized signals.

It is a further object of the invention to provide an antenna capable of at least 30 dB port-to-port isolation.

It is another object of the invention to provide an antenna array with a radome capable of preventing water and other environmental elements from entering the antenna, thereby preventing corrosion of the antenna.

It is a further object of the invention to provide an antenna that is capable of matching the unbalanced transmission line of the feed network with the balanced dipole elements.

It is yet another object of the invention to provide an antenna array that minimizes the number of antennas required, thereby providing an aesthetically pleasing base station structure that is of minimum size.

It is a further object of the invention to provide a relatively inexpensive antenna array.

It is another object of the invention to provide an antenna with high gain.

It is a further object of the invention to provide an antenna which minimizes intermodulation distortion (IMD).

These and other objects of the invention are provided by an improved antenna system for transmitting and receiving electromagnetic signals comprising a backplane having a length and a vertical axis along the length. A plurality of dipole radiating elements project outwardly from a surface of the backplane. Each of the elements includes a balanced orthogonal pair of dipoles aligned at first and second predetermined angles with respect to the vertical axis, forming crossed dipole pairs. An unbalanced feed network extends along the backplane and connected to the radiating elements. A printed circuit board balun is attached to each of the dipoles. The antenna can also include a parasitic element positioned along the vertical axis such that primary electromagnetic fields induce currents on the parasitic element, these induced currents re-radiate secondary electromagnetic fields which cancel portions of the primary electromagnetic fields, thereby improving isolation.

DETAILED DESCRIPTION OF THE PREFERRED EMBODIMENT

The present invention is useful in wireless communication systems. One embodiment of the present invention operates in the Personal Communication System (PCS)/Personal Communication Network (PCN) band of frequencies of 1850–1990 and 1710–1880 MHz, respectively. Generally, wireless telephone users transmit an electromagnetic signal to a base station comprising a plurality of antennas which receive the signal transmitted by the wireless telephone users. Although useful in wireless base stations, the present invention can also be used in all types of telecommunications systems.

Figure 1:
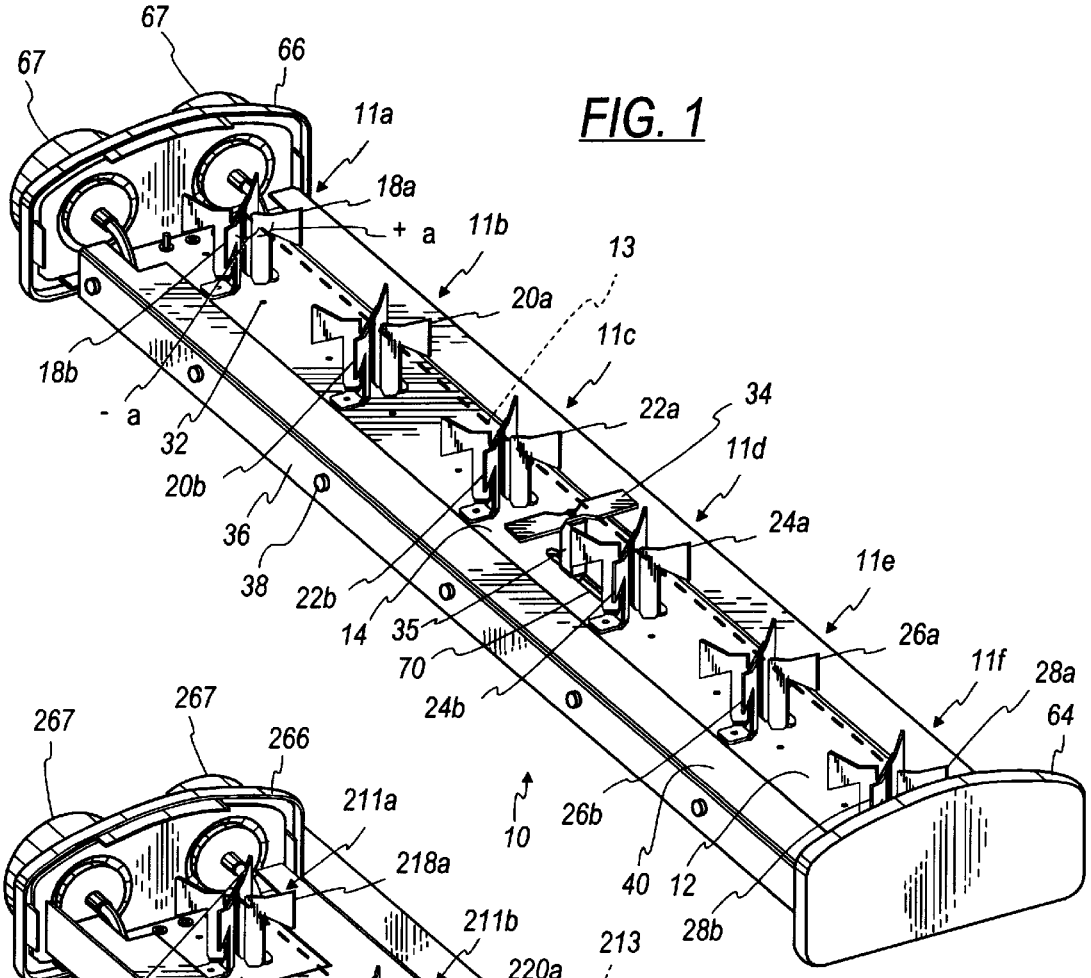
FIG. 1 is a perspective view of a top side of a backplane including six radiating elements.
Figure 3:
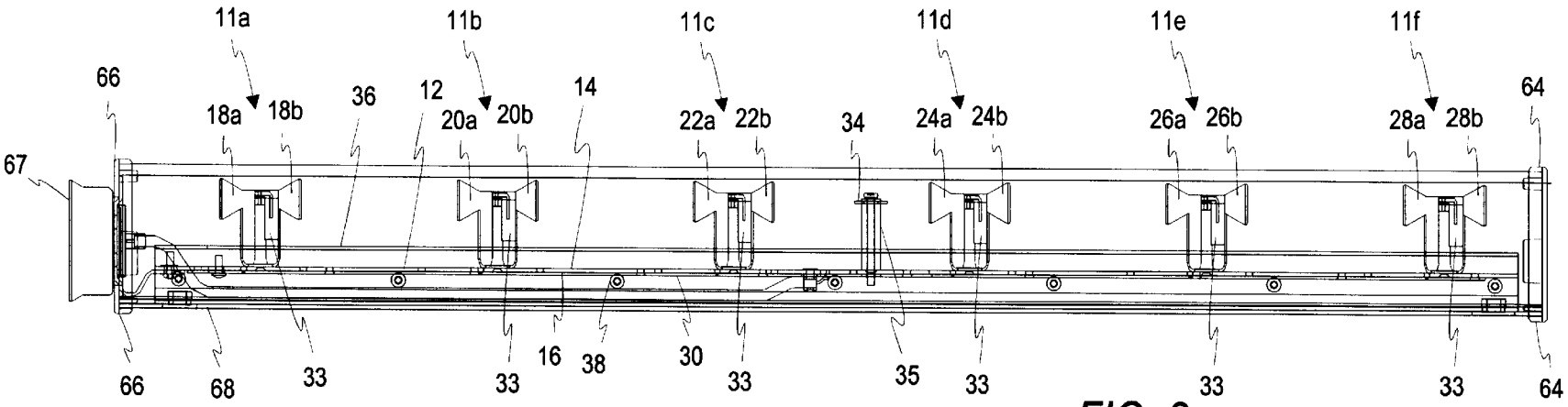
FIG. 3 is a side elevation of the backplane of FIG. 1.
Figure 2:
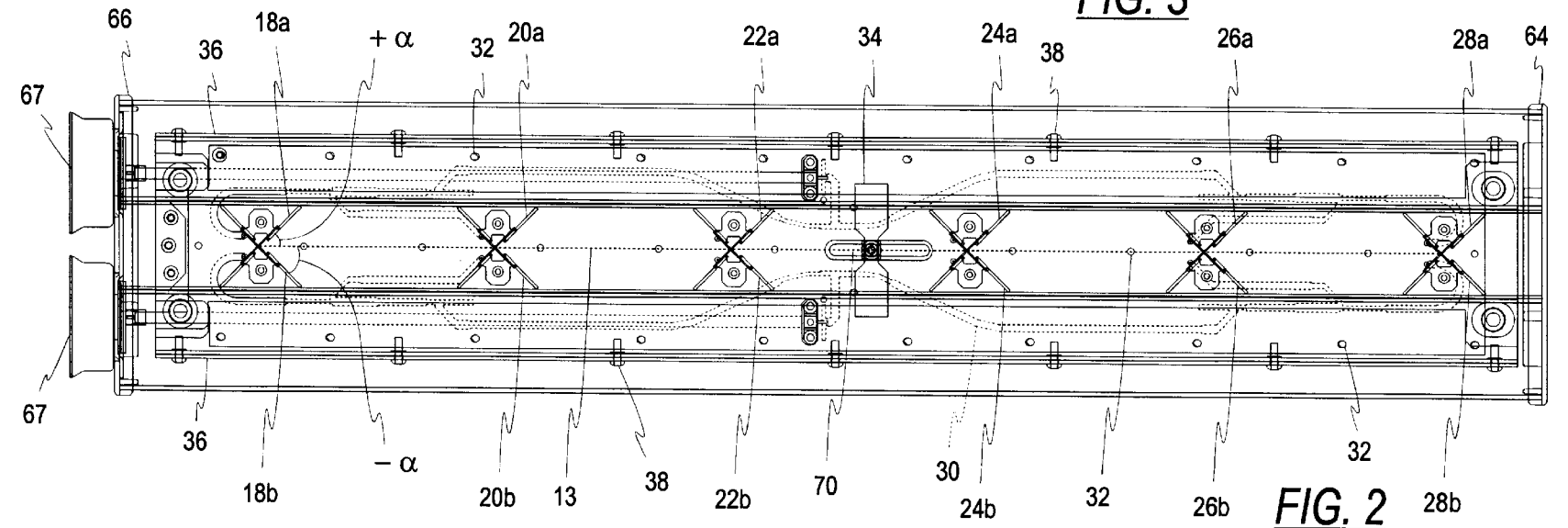
FIG. 2 is a top plan view of the top side of the backplane of FIG. 1.

The antenna illustrated in FIGS. 1–3 is a 90 degree azimuthal, half power beam width (HPBW) antenna, i.e., the antenna achieves a 90 degree 3 dB beamwidth. FIGS. 1–3 show an antenna array 10 of crossed, dual polarized dipole radiating elements 11*a–f* that are connected to a backplane 12 by screws. The backplane 12 is a metal ground plane and has a first side 14 and a second side 16 (shown in FIG. 7). The composition and dimensions of the radiating elements 11*a–f* and the backplane 12 contribute to the radiation characteristics, beam width and impedance of the antenna. Preferably, the radiating elements 11*a–f* and the backplane 12 are composed of a metal such as aluminum. However, other metals such as copper or brass can be used to construct the radiating elements and the backplane 12.

It will be understood by those skilled in the art that the gain of the antenna is proportional to the number of spaced radiating elements present in the array. In other words, increasing the number of radiating elements in the array increases the gain while decreasing the number of radiating elements decreases the antenna's gain. Therefore, although only six radiating elements are illustrated, the number of radiating elements can be increased to any number to increase the gain. Conversely, the number of radiating elements can be decreased to any number to decrease the gain.

The radiating elements 11*a–f* transmit and receive electromagnetic signals and are comprised of pairs of dipoles 18*a* and 18*b*, 20*a* and 20*b*, 22*a* and 22*b*, 24*a* and 24*b*, 26*a* and 26*b* and 28*a* and 28*b*, respectively. As illustrated by the dipoles 18*a* and 18*b*, which comprise the radiating element 11*a*, each dipole pair is crossed and configured with 45 degree slant angles (with respect to an axis 13 of the array 10). That is, the axes of the dipoles are arranged such that they are parallel with the polarization sense required. As shown, the slant angles $+\alpha$ and $-\alpha$ are +45 degrees and −45 degrees, respectively. Although shown with slant angles of +45 degrees and −45 degrees, it will be understood by those skilled in the art that these angles can be varied to optimize the performance of the antenna. Furthermore, the angles $+\alpha$ and $-\alpha$ need not be identical in magnitude. For example, $+\alpha$ and $-\alpha$ can be +30 degrees and −60 degrees, respectively.

Figure 4A:
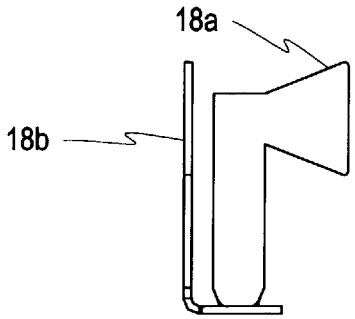
FIG. 4*a* is a side view of two half dipoles.
Figure 4B:
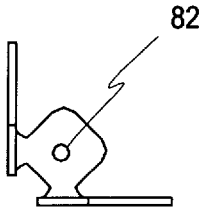
FIG. 4*b* is a top view of two half dipoles.
Figure 4C:
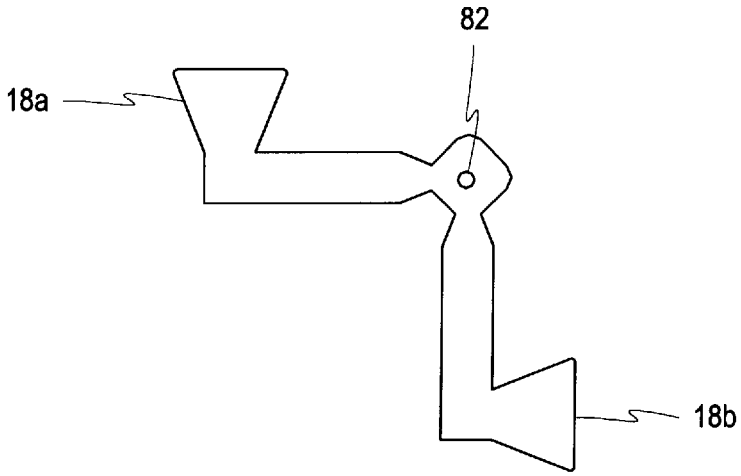
FIG. 4*c* is a top view of two half dipoles laying flat prior to each half dipole being bent approximately 90 degrees, as illustrated in FIGS. 4*a* and 4*b*.

Each dipole is comprised of a metal such as aluminum and has the shape illustrated in FIGS. 4*a–c*. FIG. 4*a* shows a side view of one half of the dipole 18*a* and one half of the dipole 18*b*. Each of said half dipoles has a generally ax-like profile, as illustrated in FIG. 4*a*. Each half dipole is physically part of the same piece of metal and is at earth ground at DC. However, each half dipole operates independently of the other at RF. FIG. 4*b* shows how each half dipole is attached to the other half dipole. Hole 82 allows a fastener such as a screw to secure each half dipole pair to the backplane 12. FIG. 4*c* shows the half dipole pairs laying flat prior to each half dipole being bent up to approximately 90 degrees with respect to the backplane 12.

Each of the radiating elements 11*a–f* receives signals having polarizations of +45 degrees and −45 degrees. That is, one dipole in the radiating element receives signals having polarizations of +45 degrees while the other dipole receives signals having polarizations of −45 degrees. The received signals from parallel dipoles, 18*a*, 20*a*, 22*a*, 24*a*, 26*a*, and 28*a* or 18*b*, 20*b*, 22*b*, 24*b*, 26*b*, and 28*b* are distributed to a receiver using a printed circuit board (PCB) feed network 30 (illustrated in FIG. 7) for each polarization. The PCB feed network 30 is attached to the second side 16 of the backplane 12 by plastic rivets 32 that minimize the intermodulation distortion (IMD). The PCB feed network 30 is located on the second side 16 in order to isolate the feed network 30 from the radiating elements 11*a–f*. The feed network 30 distributes the received signals from the array of radiating elements 11*a–f* on the first side 14 of backplane 12 to a diversity receiver for further processing. Each of the radiating elements 11*a–f* can also act as a transmitting antenna.

Figure 5:
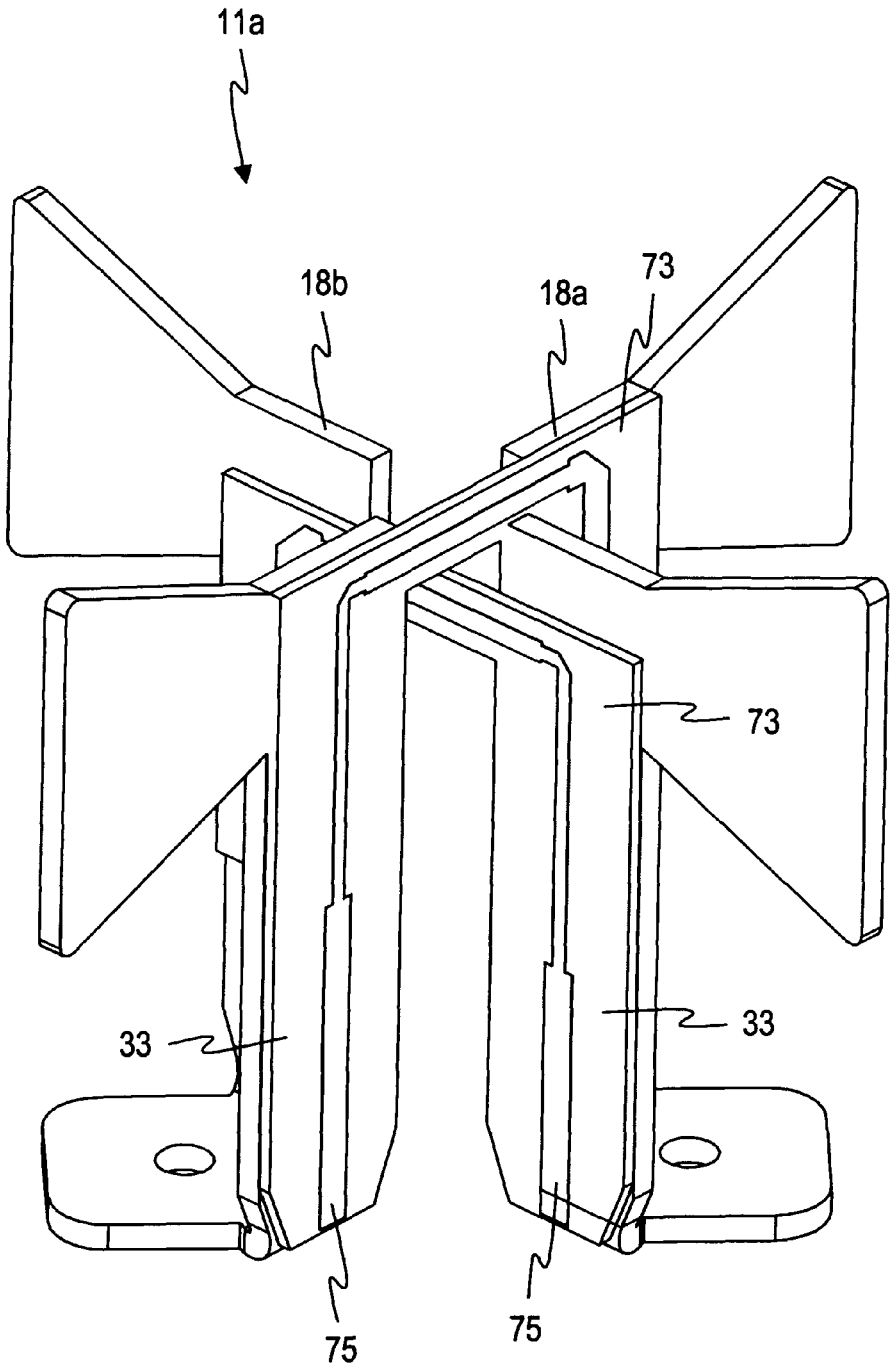
FIG. 5 is a perspective view of a radiating element illustrating the attached PCB balun.
Figure 6:
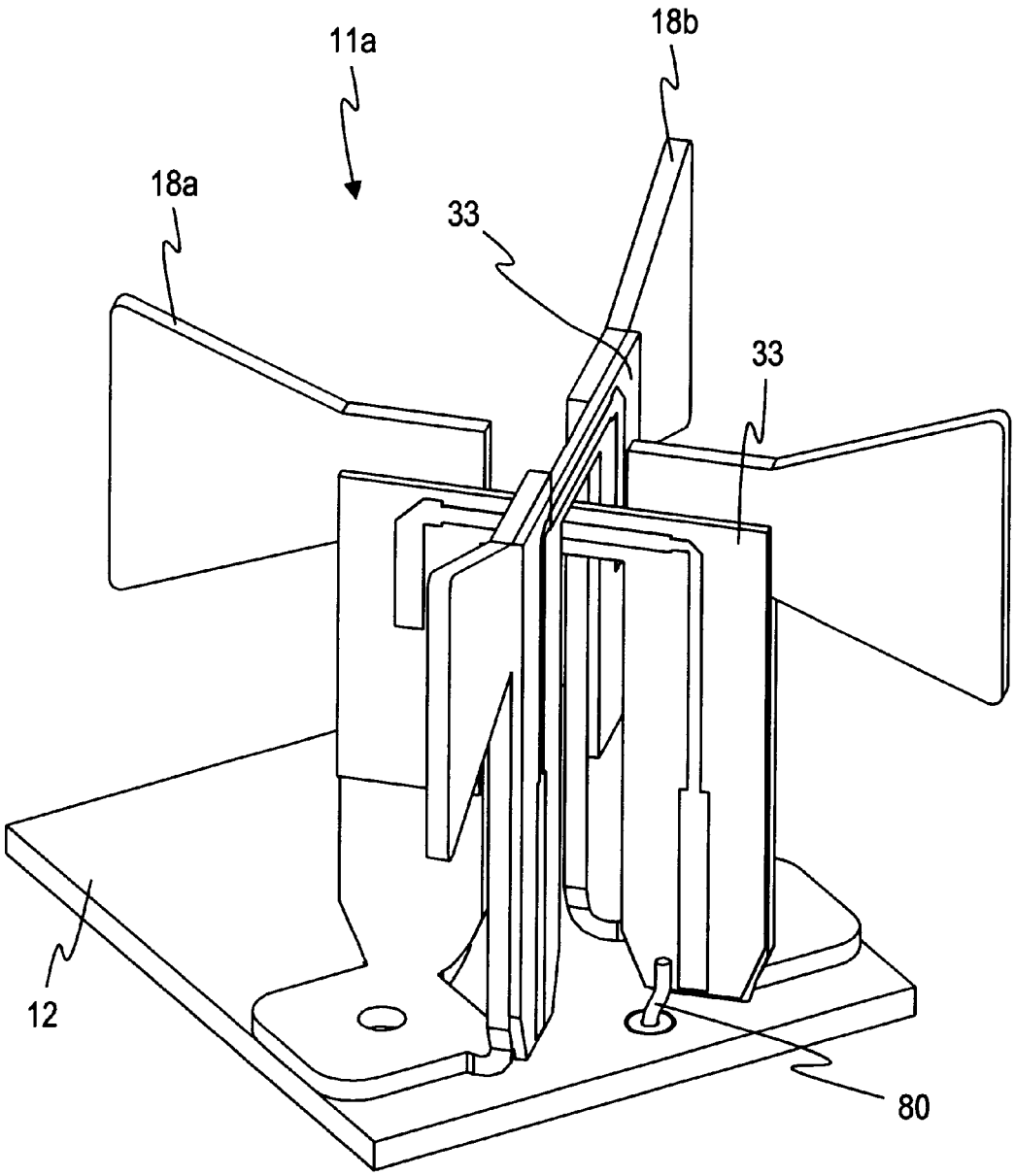
FIG. 6 is a perspective view of a radiating element illustrating the attached PCB balun and a generally Z-shaped connector.

Referring to FIG. 5, a PCB balanced/unbalanced (balun) transformer 33 is shown attached to radiating element 11*a*. The general operation of a balun is well known in the art and is described in an article by Brian Edward & Daniel Rees, *A Broadband Printed Dipole with Integrated Balun*, MICROWAVE JOURNAL, May 1987, at 339–344, which is incorporated herein by reference. One PCB balun 33 is bonded to each dipole 18*a*, 18*b*, 20*a*, 20*b*, 22*a*, 22*b*, 24*a*, 24*b*, 26*a*, 26*b*, 28*a* and 28*b*. Attaching the PCB balun 33 to the metal dipoles provides mechanical integrity to the PCB balun 33. The PCB baluns 33 match the unbalanced transmission lines of the feed network 30 with the balanced pairs of dipole elements 18*a* and 18*b*, 20*a* and 20*b*, 22*a* and 22*b*, 24*a* and 24*b*, 26*a* and 26*b* and 28*a* and 28*b*, respectively. Each PCB balun 33 is shaped like an inverted U. However, as seen in FIG. 6, in order to achieve a symmetrical pair of crossed dipoles, one leg of the inverted U is substantially longer than the other leg. Each balun 33 includes a PCB 73 and a wire lead 75 for matching the unbalanced feed network 30 with each balanced pair of dipoles. A PCB balun avoids the need for small metal and plastic parts in constructing the balun. The PCB balun 33 is connected to the PCB feed network 30 by a generally Z-shaped connector 80, partially illustrated in FIG. 6. The Z-shaped connector 80 comprises two parallel sections spaced by a slanted section. This configuration allows for tolerance buildup between the dipole element, the backplane and the PCB feed network 30.

Referring to FIGS. 1–3, a parasitic element 34 is positioned transverse to the vertical axis 13 approximately midway along the length of the backplane 12. In order for currents to be induced, the parasitic element 34 is formed of metal. This metal is preferably aluminum, although other metals such as copper or brass can also be used. A primary electromagnetic wave or field incident upon the array structure induces currents on the surfaces of the crossed dipoles of each of the radiating elements 11*a–f*, the parasitic element 34, and the surrounding metal structure. These induced currents create a weaker secondary electromagnetic field which will combine with the primary electromagnetic field. A state of equilibrium will occur such that the final electromagnetic field is different from the primary electromagnetic field. The dimensions and position of the parasitic element 34 are factors in determining the final field. The improved isolation of the present invention is achieved by currents induced on the parasitic element 34 which re-radiate energy that cancels the energy which couples from one polarization to the other thereby causing an increase in isolation. Specifically, primary electromagnetic fields induce currents in the metallic parasitic element 34, these induced currents re-radiate secondary electromagnetic fields that cancel with portions of the primary electromagnetic fields, thereby improving isolation.

The parasitic element 34 is shaped like a bow tie and is positioned transverse to the vertical axis 13 approximately midway along the length of the backplane 12. The parasitic element 34 is mounted on a dielectric standoff 35 which is fastened to the backplane 12 by a vertical screw disposed within the standoff 35. The parasitic element 34 is positioned in a plane generally horizontal to the backplane 12 at a height approximately equal to the height of the midpoint of the vertical bow tie shaped crossed dipoles 18*a* and 18*b*, 20*a* and 20*b*, 22*a* and 22*b*, 24*a* and 24*b*, 26*a* and 26*b* and 28*a* and 28*b*. This height has been found to optimize isolation for this array configuration. However, the height of the parasitic element 34 can vary depending on the array configuration. A network analyzer is used to determine the optimum positioning of the element. The network analyzer measures the isolation of any given configuration of radiating elements 11*a–f* and the parasitic element 34. The dielectric standoff 35 is disposed in a slot 70 that allows the dielectric standoff 35 to be adjusted with respect to the axis 13. This allows for the optimal axial displacement of the parasitic element 34. The dimensions of the parasitic element 34 control the magnitude of the current produced. Thus, the performance of the system can also be optimized by changing the dimensions of the parasitic element 34.

The parasitic element 34 is situated to prevent undue side effects such as degrading the return loss voltage standing wave ratio (VSWR) and disturbing the normal array radiation patterns. It has been found that optimum antenna performance occurs when the parasitic element 34 is placed parallel to or perpendicular to the vertical axis 13 of the array 10. Tests performed on a pattern test range and/or network analyzer are used to determine the optimum antenna performance for any given antenna array configuration.

Figure 7:
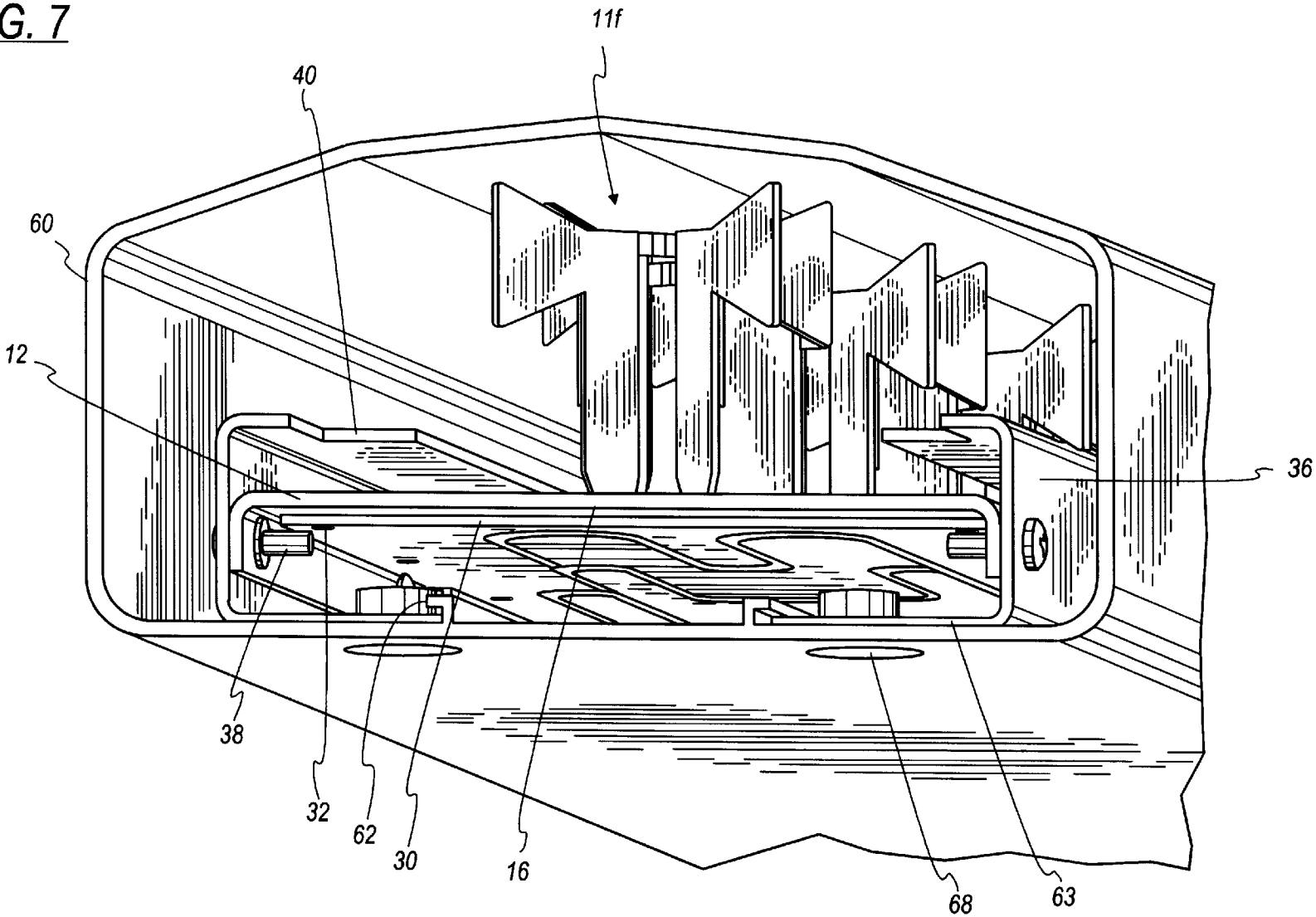
FIG. 7 is a perspective view of the near end of the backplane illustrated in FIG. 1, with the end cap removed, illustrating the radome.

A pair of sidewalls 36 contribute to the 90 degree azimuthal radiation pattern of the antenna 10. The sidewalls 36 are fastened to the backplane 12 along the length of the backplane 12 by screws 38 illustrated in FIG. 7. The sidewalls 36 are substantially C-shaped in cross-section and extend partially around the backplane 12. The sidewalls 36 have a portion 63 that extends partially under the backplane 12, as illustrated in FIG. 7. Preferably, the sidewalls 36 are composed of a metal such as aluminum. However, other metals such as copper or brass can be used to construct the sidewalls 36. The edges 40 of the sidewalls 36 create a diffraction pattern that increases the beamwidth approximately 10 degrees compared to similar antennas with no sidewalls. In other words, the edges 40 diffract part of the signal, thereby spreading the signal out. Thus, the 3 dB beamwidth of the transmitted or received signal is increased. Furthermore, because of the width required for the PCB feed network 30, the metal backplane 12 of the antenna 10 is greater in width than other backplanes using alternative feed networks. The increased metal of the backplane 12 and the sidewalls 36 help to increase the front to back ratio, thereby improving the performance of the antenna 10. The composition and dimensions of the sidewalls 36 thus contribute to the radiation characteristics, beam width and the impedance of the antenna.

The gain of the antenna 10 is maximized due to the use of dipole radiating elements 11*a–f* which are an efficient radiator and by using an efficient (0.062" thick) PCB feed network 30.

FIG. 7 also illustrates a radome 60 that encloses the antenna array 10. The radome 60 is secured to the antenna 10 by guide rails 62 integrally formed with the radome 60. Guide rails 62 mate with the portion 63 of the sidewalls 36 that extends under the backplane 12. The tight, frictional engagement between the guide rails 62 and the sidewalls 36 prevents the antenna 10 from moving inside the radome 60 and also prevents water and other environmental elements from entering the antenna, thereby preventing corrosion of the antenna 10. End caps 64 and 66, best illustrated in FIG. 1, snap onto the radome to seal in the antenna 10 and protect the antenna from adverse environmental conditions. The end cap 66 has two DIN connectors 67 that allow coaxial cables to electrically connect each dipole of the antenna 10 with an external device such as a receiver or transmitter. Gaskets 68, illustrated in FIG. 7, seal the fasteners that connect the antenna 10 to a base station. This further protects the antenna 10 from water and other environmental elements.

Figure 8:
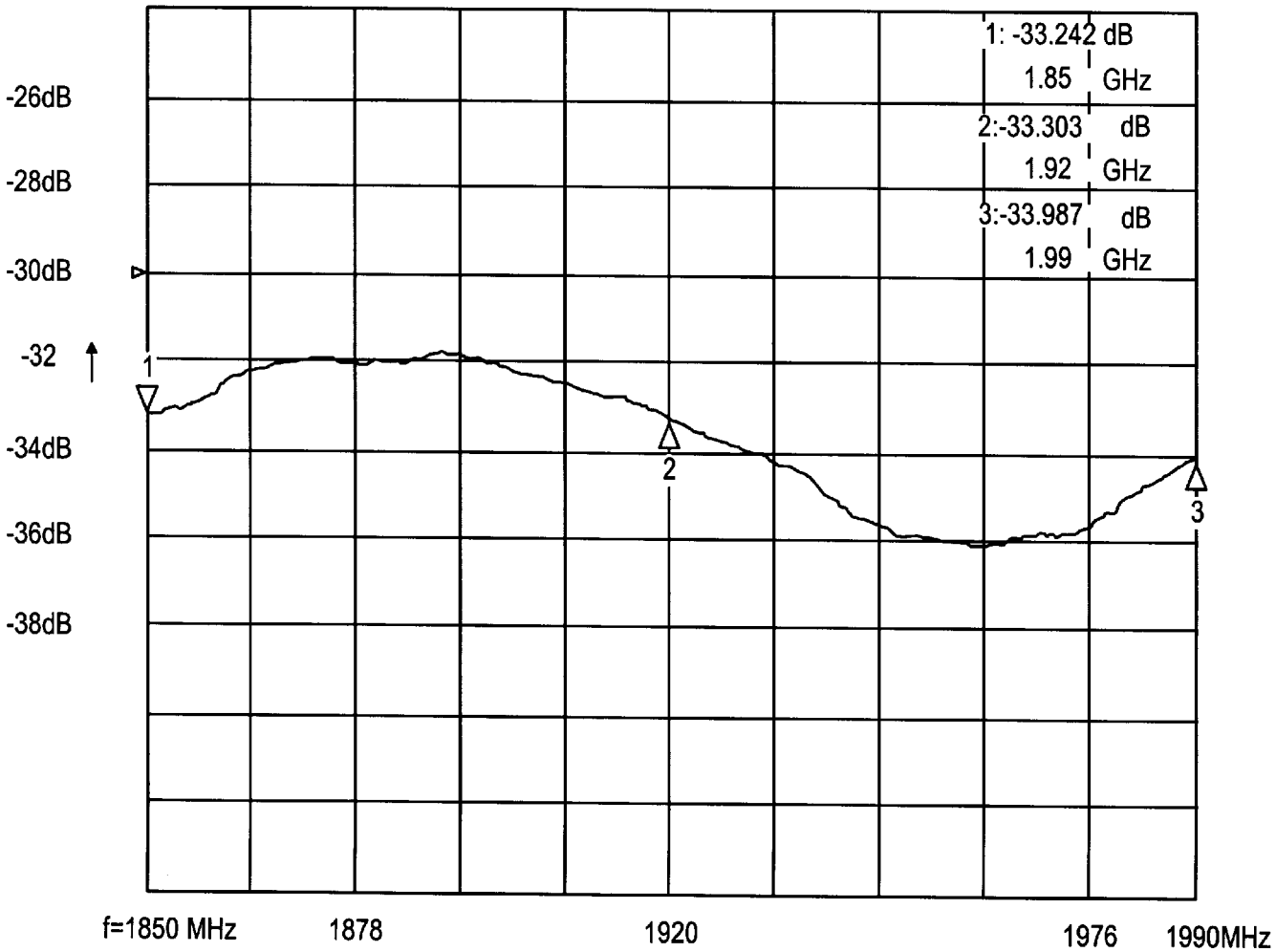
FIG. 8 is a graph illustrating the coupling of the antenna of FIGS. 1–3.

In the illustrated embodiment of FIGS. 1–3, six crossed dipole radiating elements were placed on a backplane 830.10 mm long by 172.67 mm wide to operate in the PCS/PCN band of frequencies which is 1710–1990 MHz. The vertical axis 13 of the array 10 stretched along the 830.10 mm length. The six dual polarized, crossed dipole radiating elements 11*a–f* were aligned along the vertical axis 13 of the array 10, each element having slant angles of +45 degrees and −45 degrees with respect to the vertical axis 13. The PCB used for the PCB feed network 30 is approximately 0.062" thick and the PCB used for the PCB balun 33 is approximately 0.032" thick, both of the PCB's having a dielectric constant of 3.0. The illustrated antenna configuration achieved the isolation curve illustrated in FIG. 8. The graph of FIG. 8 actually represents coupling. However, coupling is the opposite of isolation, i.e., coupling of 33 dB is equivalent to 33 dB isolation.

Figure 9:
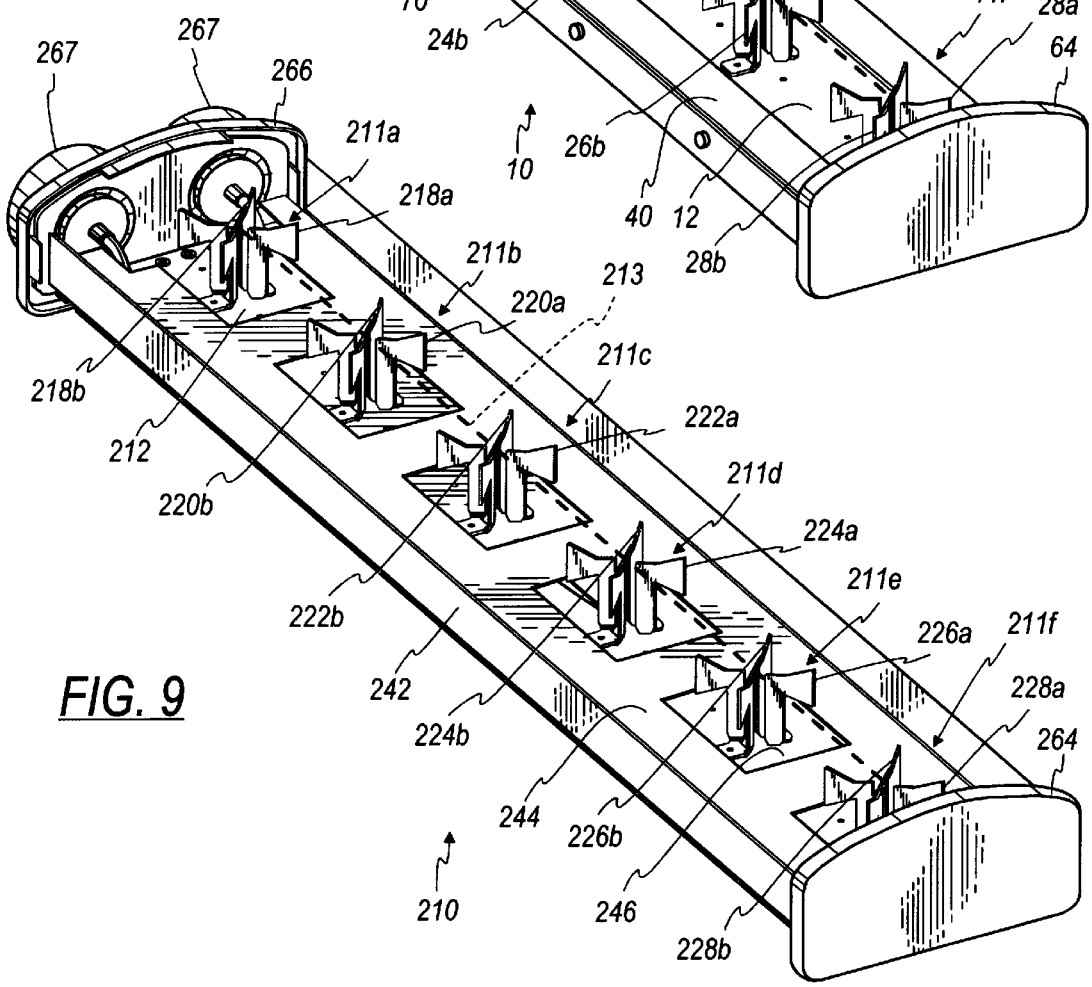
FIG. 9 is a perspective view of a top side of a backplane including six radiating elements and a plate with apertures for accommodating the radiating elements.
Figure 10:
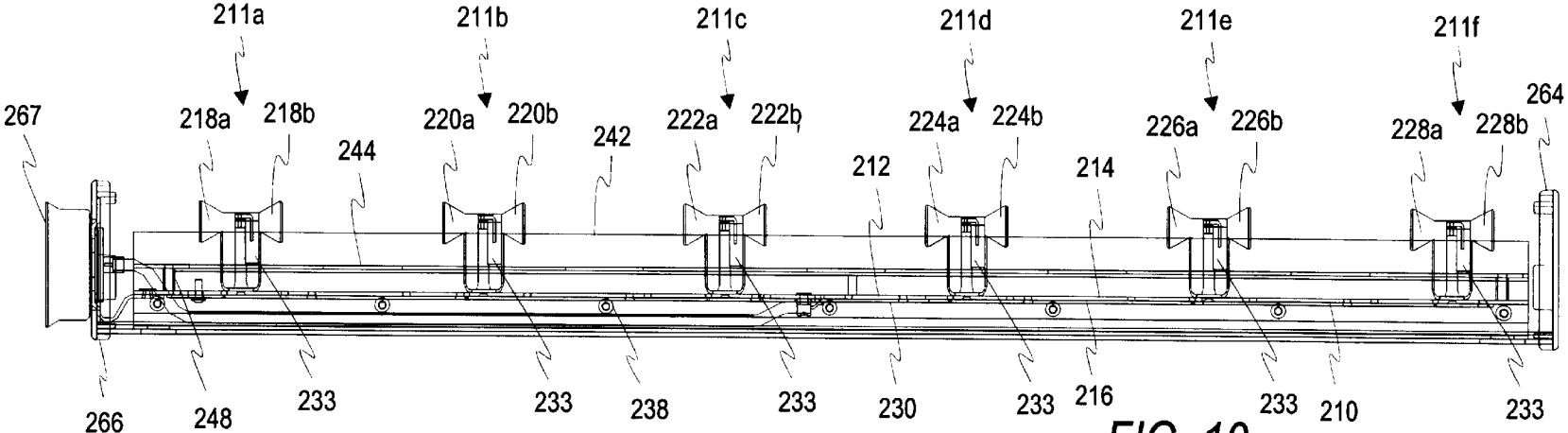
FIG. 10 is a top plan view of the top side of the backplane of FIG. 9.
Figure 11:
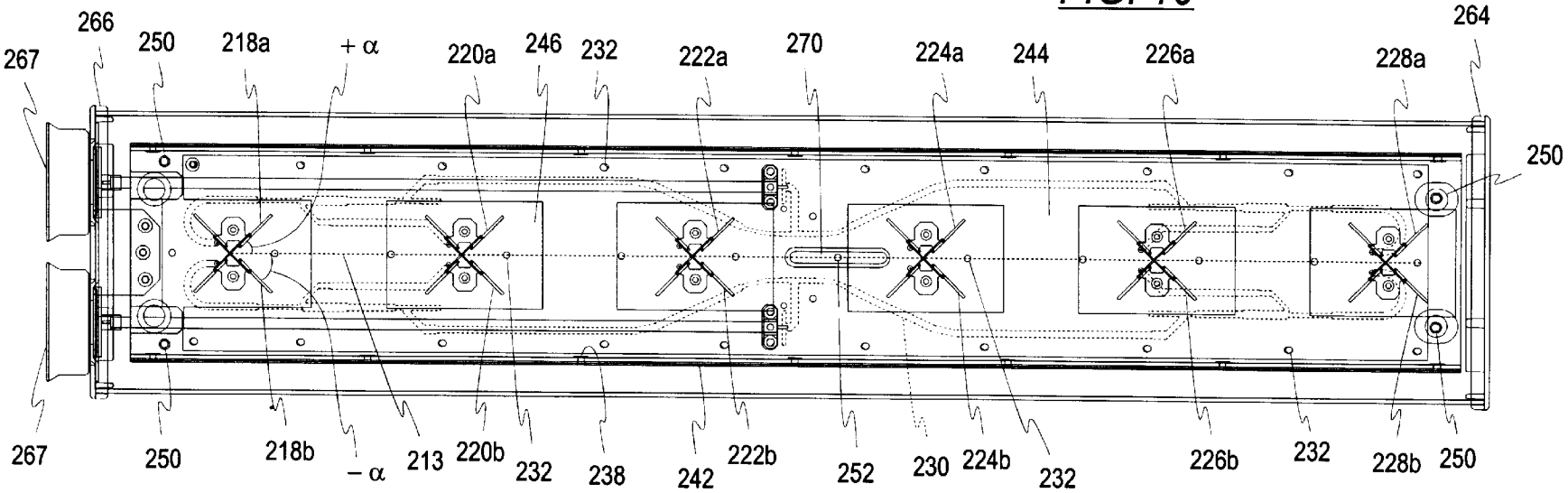
FIG. 11 is a side elevation of the backplane of FIG. 9.

The antenna illustrated in FIGS. 9–11 is a 65 degree azimuthal HPBW antenna, i.e., the antenna achieves a 65 degree 3 dB beamwidth. FIGS. 9–11 show an antenna array 210 of crossed, dual dipole radiating elements 211*a–f* that are attached to a backplane 212. The antenna 210 operates in the PCS/PCN band of frequencies of 1850–1990 and 1710–1880 MHz, respectively. As discussed above, the composition and dimensions of the backplane 212 and the radiating elements 211*a–f* contribute to the radiation characteristics, beam width and the impedance of the antenna. Because much of the antenna 210 is identical to the antenna 10 described above, the description below focuses on those portions of the antenna 210 that are different from the antenna 10.

The radiating elements 211*a–f* transmit and receive electromagnetic signals and are comprised of pairs of dipoles, 218*a* and 218*b*, 220*a* and 220*b*, 222*a* and 222*b*, 224*a* and 224*b*, 226*a* and 226*b* and 228*a* and 228*b*, respectively. The dipoles comprising the radiating elements 211*a–f* are crossed and configured with 45 degree slant angles (with respect to an axis 213 of the array 210).

Each of the radiating elements 211*a–f* receives signals having polarizations of +45 degrees and −45 degrees. The received signals from parallel dipoles, 218*a*, 220*a*, 222*a*, 224*a*, 226*a*, and 228*a* or 218*b*, 220*b*, 222*b*, 224*b*, 226*b*, and 228*b* are distributed to a receiver using a printed circuit board (PCB) feed network 230 (illustrated in FIG. 14) for each polarization. The PCB feed network 230 is attached to a bottom side 216 of the backplane 212 by plastic rivets 232 in order to minimize the intermodulation distortion (IMD). The feed network 230 distributes the received signals from the array of radiating elements 211*a–f* on the top side 214 of backplane 212 to a diversity receiver which chooses the stronger of the two signals for further processing. Each of the radiating elements 211*a–f* can also act as a transmitting antenna.

Figure 12:
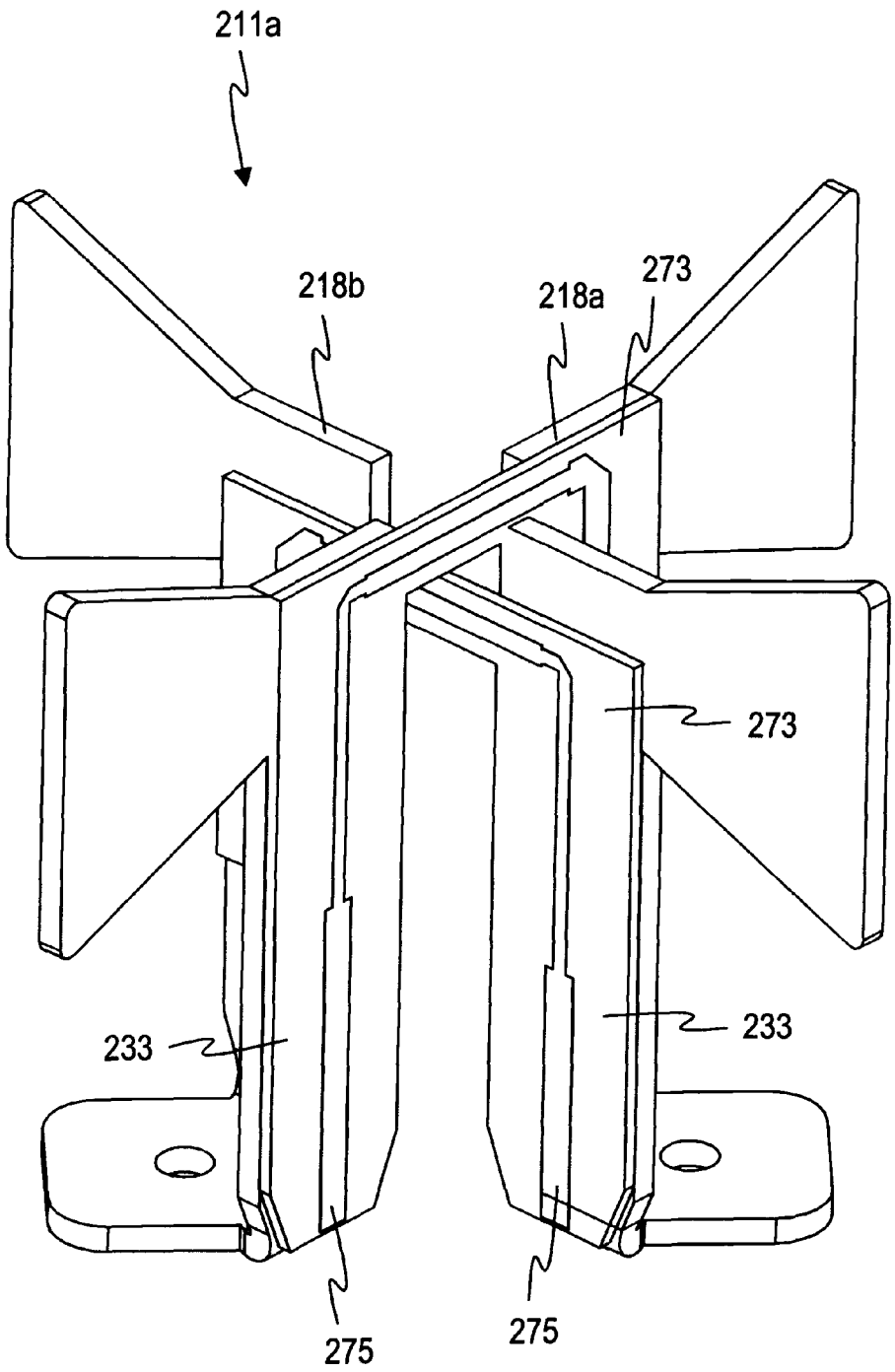
FIG. 12 is a perspective view of a radiating element illustrating the attached PCB balun.
Figure 13:
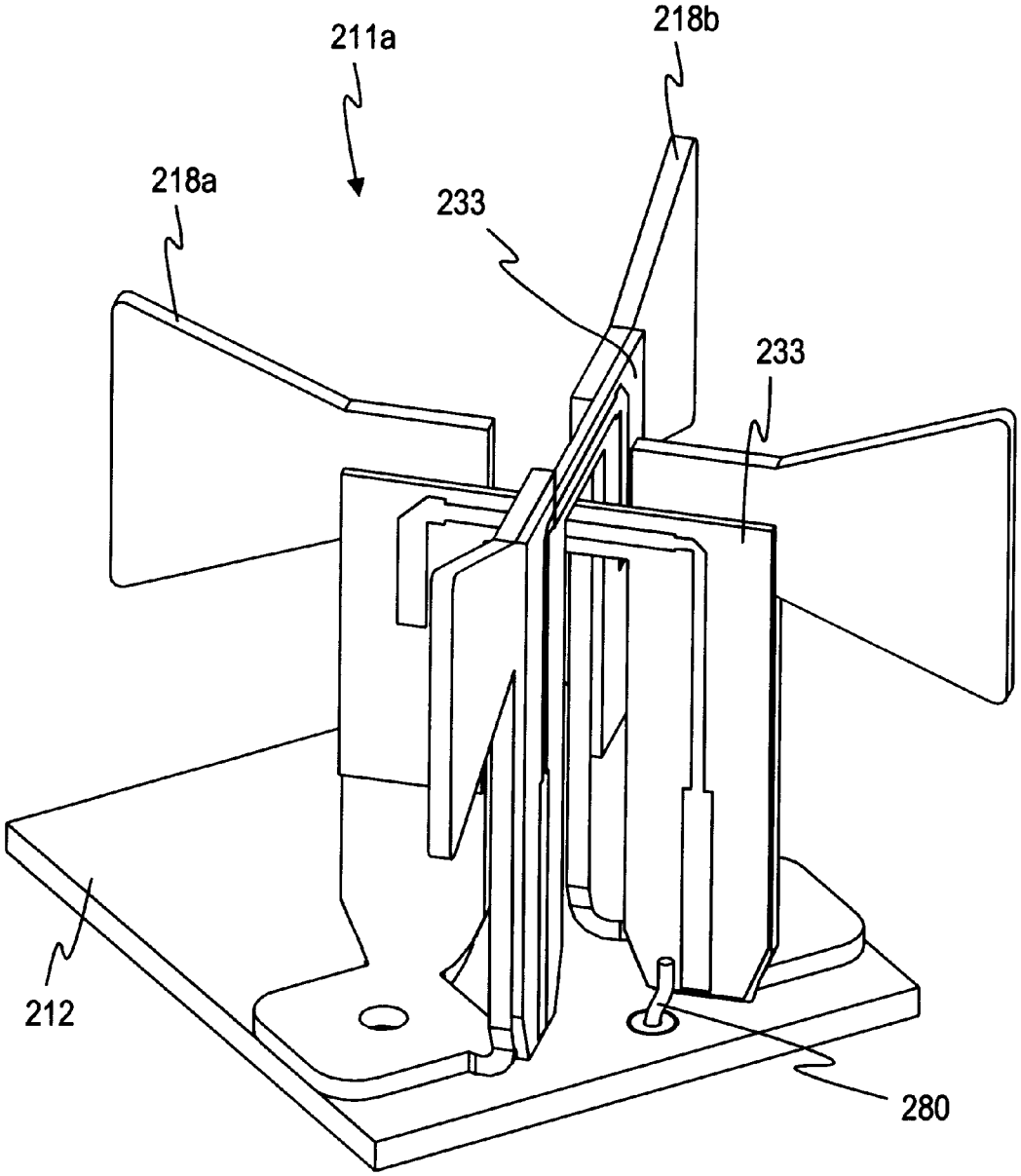
FIG. 13 is a perspective view of a radiating element illustrating the attached PCB balun and a generally Z-shaped connector.

Referring to FIG. 12, a PCB balun transformer 233 is shown attached to radiating element 211*a*. One PCB balun 233 is bonded to each dipole 218*a*, 218*b*, 220*a*, 220*b*, 222*a*, 222*b*, 224*a*, 224*b*, 226*a*, 226*b*, 228*a* and 228*b*. Attaching the PCB balun 33 to the metal dipoles provides mechanical integrity to the PCB balun 33. The PCB baluns 233 match the unbalanced transmission lines of the feed network 230 with the balanced dipole elements 218*a* and 218*b*, 220*a* and 220*b*, 222*a* and 222*b*, 224*a* and 224*b*, 226*a* and 226*b* and 228*a* and 228*b*, respectively. Each PCB balun 233 is shaped like an inverted U. However, as seen in FIG. 13, in order to achieve a symmetrical pair of crossed dipoles, one leg of the inverted U is substantially longer than the other leg. Each balun 233 includes a PCB 273 and a wire lead 275 for matching the unbalanced feed network 230 with each pair of balanced dipoles. A PCB balun alleviates the necessity to use small metal and plastic parts in constructing the balun. The PCB balun 233 is connected to the PCB feed network 230 by a generally Z-shaped connector 280, illustrated in FIG. 13. The Z-shaped connector 280 comprises two parallel sections spaced by a slanted section. This configuration allows for tolerance buildup between the dipole element, the backplane and the PCB feed network 230.

Referring again to FIG. 9, a plate 244 having square apertures 246 is supported and elevated from the backplane 212 by dielectric standoffs 248, best illustrated in FIG. 11. Metal screws 250 and a non-conducting screw 252 secure the plate 244 and the dielectric standoffs 248 to the backplane 212. As illustrated in FIG. 10, the metal screws 250 secure the plate 244 and four dielectric standoffs 248 to the corners of the backplane 212. The non-conducting screw 252 secures the middle portion of plate 244 and one dielectric standoff 248 to the backplane 212. The symmetry of the plate 244 helps improve the port-to-port isolation and the cross polarization of the antenna 210.

A pair of sidewalls 242 contribute to the 65 degree azimuthal radiation pattern of the antenna 210. The sidewalls 242 are fastened to the backplane 212 along the length of the backplane 212 by screws 238 illustrated in FIG. 14. The sidewalls 242 are substantially L-shaped in cross-section and have a portion 263 that extends partially under the backplane 212. The sidewalls 242 narrow the 3 dB beamwidth of the antenna 210 compared to similar antennas with no sidewalls.

The gain of the antenna 210 is maximized due to the use of dipole radiating elements 211*a–f* which are an efficient radiator and by using an efficient (0.062" thick) PCB feed network 230.

Figure 14:
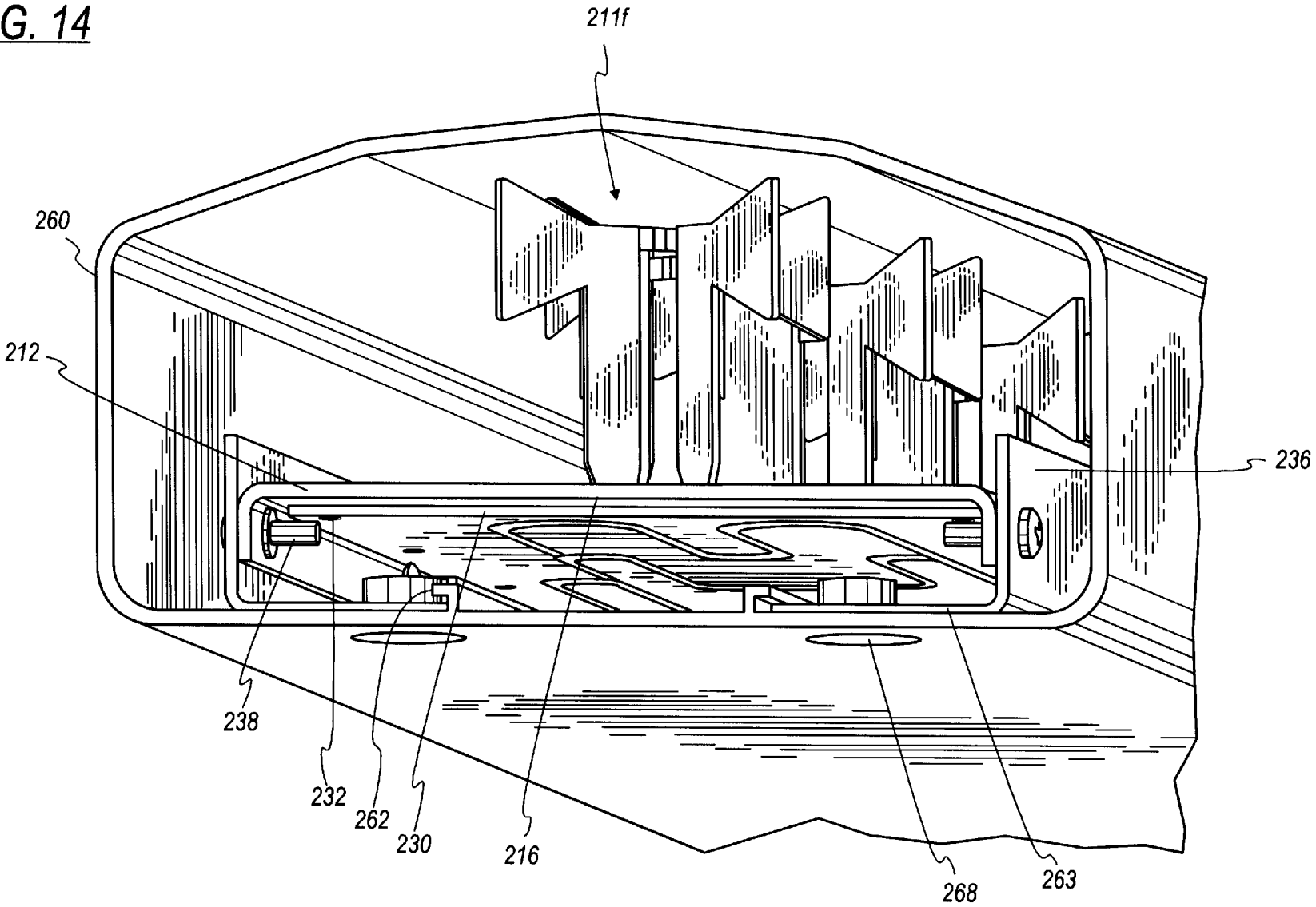
FIG. 14 is a perspective view of the near end of the backplane illustrated in FIG. 9, with the end cap removed, illustrating the radome.

Similar to the antenna 10 of FIGS. 1–3, a radome 260 likewise encloses the antenna array 210, as illustrated in FIG. 14. The radome 260 is secured to the antenna 210 by guide rails 262 integrally formed with the radome 260. Guide rails 262 mate with a portion 263 of sidewalls 242 that extends under the backplane 212. The tight, frictional engagement between the guide rails 262 and the sidewalls 242 prevents antenna 210 from moving inside the radome 260 and also prevents water and other environmental elements from entering the antenna, thereby preventing corrosion of the antenna 210. End caps 264 and 266, best illustrated in FIG. 9, snap onto the radome to seal in the antenna 210 and protect the antenna from adverse environmental conditions. End cap 266 has two DIN connectors that allow coaxial cables to electrically connect each dipole of the antenna 210 with an external device such as a receiver or transmitter. Gaskets 268 seal the fasteners that connect the antenna 210 to a base station. This further protects the antenna 210 from water and other environmental elements.

Figure 15:
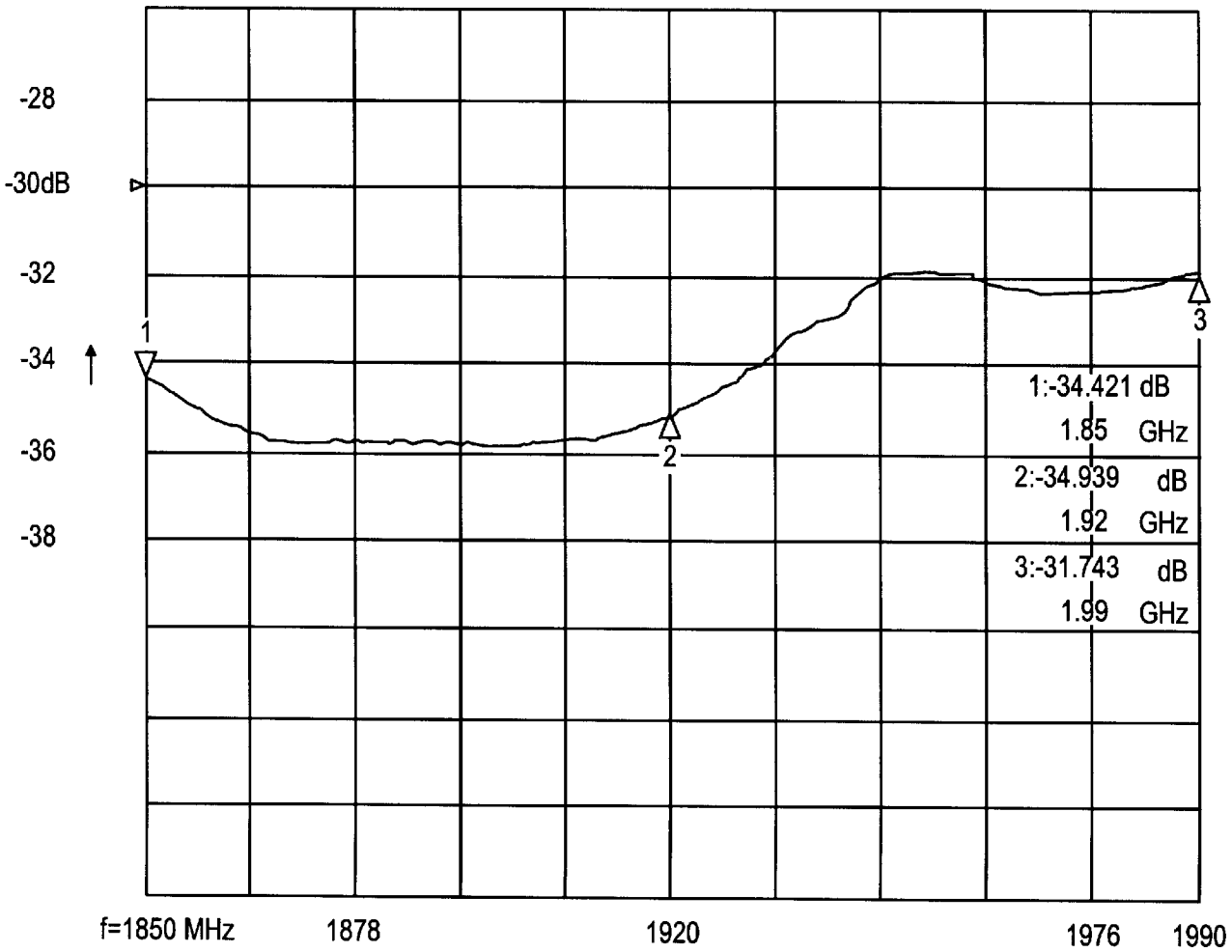
FIG. 15 is a graph illustrating the coupling of the antenna of FIGS. 9–11.

In the illustrated embodiment of FIGS. 9–11, six crossed dipole radiating elements were placed on a backplane 830.10 mm long by 172.67 mm wide to operate in the PCS/PCN band of frequencies which is 1710–1990 MHz. The vertical axis 213 of the array 210 stretched along the 830.10 mm length. The six dual polarized, crossed dipole radiating elements 211*a–f* were aligned along the vertical axis 213 of the array 210, each element having slant angles of +45 degrees and −45 degrees with respect to the vertical axis 213. The PCB used for the PCB feed network 230 is approximately 0.062" thick and the PCB used for the PCB balun 233 is approximately 0.032" thick, both of the PCB's having a dielectric constant of 3.0. The illustrated antenna configuration achieved the isolation curve illustrated in FIG. 15. The graph of FIG. 15 actually represents coupling. However, coupling is the opposite of isolation, i.e., coupling of −34 dB is equivalent to 34 dB isolation.

The antenna of the present invention includes dual polarized radiating elements that produce two orthogonally polarized signals. The present invention further provides an antenna array comprised of crossed dipoles. The present antenna array improves the isolation between the electromagnetic fields produced by the crossed dipoles. The present antenna array also minimizes the number of antennas required in a wireless telecommunication system, thereby providing an aesthetically pleasing base station that is of minimum size. Moreover, the present antenna array provides approximately 30 dB port-to-port isolation. The present invention also provides a less expensive antenna array capable of high gain.

While the present invention has been described with reference to one or more preferred embodiments, those skilled in the art will recognize that many changes may be made thereto without departing from the spirit and scope of the present invention which is set forth in the following claims.

What is claimed is:

1. A dual polarized antenna for transmitting and receiving electromagnetic signals comprising:

a backplane having a length and a vertical axis along said length;

a plurality of dipole radiating elements projecting outwardly from a surface of said backplane, each of said elements including a balanced orthogonal pair of dual polarized dipoles aligned at first and second predetermined angles with respect to said vertical axis, forming crossed dipole pairs;

an unbalanced feed network extending along said backplane and connected to said radiating elements; and a plurality of printed circuit board baluns, one of said baluns being attached to each of said dipoles.

2. The antenna of claim 1 wherein each of said dipole pairs arc formed from metal plates attached to said backplane so said plates are generally orthogonal to said surface of said backplane, one of said printed circuit board baluns being laminated to each of said dipoles.

3. The antenna of claim 1 wherein each of said dipoles is comprised of two half dipoles each having a base, said half dipoles being connected at said base.

4. The antenna of claim 1 wherein said dipole pairs are attached to said backplane by fasteners selected from the group consisting of screws, bolts, rivets, and straps.

5. The antenna of claim 1 wherein said dipoles comprise two half dipoles, each of said half dipoles having a generally ax-like profile.

6. The antenna of claim 1 wherein one of said printed circuit board baluns is adhesively bonded to each of said dipoles.

7. The antenna of claim 1 wherein said printed circuit board baluns are generally shaped like an inverted U.

8. The antenna of claim 1 further including a plurality of conductive elements extending through said backplane for connecting said feed network to said dipole elements.

9. The antenna of claim 1 further including a plurality of generally Z-shaped connectors that allow for tolerance buildup between said dipoles, said backplane and said feed network, said connectors connecting said dipoles through said backplane to said feed network.

10. The antenna of claim 1 further including a parasitic element positioned along said vertical axis such that primary electromagnetic fields induce currents on said parasitic element, these induced currents re-radiate secondary electromagnetic fields which cancel portions of said primary electromagnetic fields.

11. The antenna of claim 10 wherein said parasitic element is positioned approximately transverse to said vertical axis approximately midway along said length.

12. The antenna of claim 10 wherein said parasitic element is composed of aluminum.

13. The antenna of claim 1 wherein said feed network is a printed circuit board feed network that includes microstrip transmission lines.

14. The antenna of claim 1 whereby said first predetermined angle is substantially equal to +45 degrees with respect to said vertical axis and said second predetermined angle is substantially equal to −45 degrees with respect to said vertical axis.

15. The antenna of claim 1 wherein said feed network is attached to said backplane by plastic rivets.

16. The antenna of claim 1 further comprising a radome having integral guide rails that secure said radome to said antenna.

17. The antenna of claim 1 further comprising a member extending along a longitudinal edge of said backplane and having an elongated diffracting edge disposed between said backplane and a top of said radiating elements for increasing the azimuthal beamwidth.

18. The antenna of claim 17 wherein said member is substantially C-shaped.

19. The antenna of claim 1 wherein said backplane is a ground plane composed of metal.

20. A dual polarized antenna for transmitting and receiving electromagnetic signals comprising:

a backplane having a length and a vertical axis along said length;

a plurality of dipole radiating elements projecting outwardly from a surface of said backplane, each of said elements including a balanced orthogonal pair of dual polarized dipoles aligned at first and second predetermined angles with respect to said vertical axis, forming crossed dipole pairs; and a member extending along a longitudinal edge of said backplane and having an elongated diffracting edge disposed between said backplane and a top of said radiating elements for increasing the azimuthal beamwidth.

21. The antenna of claim 20 wherein said member is substantially C-shaped.

22. The antenna of claim 20 wherein each of said dipole pairs is formed from metal plates attached to said backplane so said plates are generally orthogonal to said surface of said backplane.

23. The antenna of claim 20 further comprising printed circuit board baluns that have the general shape of an inverted U.

24. The antenna of claim 23 wherein one of said printed circuit board baluns is laminated to each of said dipoles.

25. The antenna of claim 20 wherein each of said dipoles is comprised of two half dipoles each having a base, said half dipoles being connected at said base.

26. The antenna of claim 20 wherein said dipole pairs are attached to said backplane by fasteners selected from the group consisting of screws, bolts, rivets, and straps.

27. The antenna of claim 20 wherein said dipoles comprise two half dipoles, each of said half dipoles having a generally ax-like profile.

28. The antenna of claim 20 further including a plurality of conductive elements extending through said backplane for connecting said feed network to said dipole elements.

29. The antenna of claim 20 further including a plurality of generally Z-shaped connectors that allow for tolerance buildup between said dipoles, said backplane and said feed network, said connectors connecting said dipoles through said backplane to said feed network.

30. The antenna of claim 20 further including a diversity reception means coupled to said plurality of radiating elements for receiving and processing an electrical signal.

31. The antenna of claim 20 further including a parasitic element positioned approximately transverse to said vertical axis approximately midway along said length.

32. The antenna of claim 31 wherein said parasitic element is composed of aluminum.

33. The antenna of claim 20 wherein said feed network is attached to said backplane by plastic rivets.

34. The antenna of claim 20 wherein said backplane is a ground plane composed of metal.

35. The antenna of claim 20 further comprising a radome having integral guide rails that secure said radome to said antenna.

36. A method for providing improved isolation for an array of radiating elements comprising the steps of:

providing a backplane having a length and a vertical axis along said length;

providing a plurality of dipole radiating elements projecting outwardly from a surface of said backplane, each of said elements including a balanced orthogonal pair of dual polarized dipoles aligned at first and second predetermined angles with respect to said vertical axis, forming crossed dipole pairs;

providing an unbalanced feed network extending along said backplane;

connecting said unbalanced feed network to said radiating elements;

providing a plurality of printed circuit board baluns; and attaching one of said printed circuit board baluns to each of said dipoles.

37. The method of claim 36 comprising the further step of providing a parasitic element positioned along said vertical axis such that primary electromagnetic fields induce currents on said parasitic element, these induced currents re-radiate secondary electromagnetic fields which cancel portions of said primary electromagnetic fields.

38. The method of claim 36 comprising the further steps of forming each of said dipole pairs from metal plates, attaching said plates to said backplane so said plates are generally orthogonal to said surface of said backplane, and laminating one of said printed circuit board baluns to each of said dipoles.

39. The method of claim 36 wherein said printed circuit board baluns are generally shaped like an inverted U.

40. A method for providing improved isolation for an array of radiating elements comprising the steps of:

providing a backplane having a length and a vertical axis along said length;

providing a plurality of dipole radiating elements projecting outwardly from a surface of said backplane, each of said elements including orthogonal pairs of dual polarized dipoles aligned at first and second predetermined angles with respect to said vertical axis, forming crossed dipole pairs; and providing a member extending along a longitudinal edge of said backplane and having an elongated diffracting edge disposed between said backplane and a top of said radiating elements for increasing the azimuthal beamwidth.

41. The method of claim 40 wherein said member is substantially C-shaped.

42. The method of claim 40 comprising the further steps of forming each of said dipole pairs from metal plates, and attaching said plates to said backplane so said plates are generally orthogonal to said surface of said backplane.

43. The method of claim 40 comprising the further step of providing printed circuit board baluns that have the general shape of an inverted U.

44. The method of claim 43 wherein one of said printed circuit board baluns is laminated to each of said dipoles.

45. The method of claim 40 comprising the further step of providing a parasitic element positioned approximately transverse to said vertical axis approximately midway along said length.

46. A dual polarized antenna for transmitting and receiving electromagnetic signals comprising:

a backplane having a top side, a length and a vertical axis along said length;

an unbalanced feed network attached to said backplane;

a plurality of dipole radiating elements projecting outwardly from a surface of said backplane, each of said elements including orthogonal pairs of dual polarized dipoles aligned at first and second predetermined angles with respect to said vertical axis, forming crossed dipole pairs; and a plate with apertures, said plate displaced above said top side of said backplane for improving isolation and cross polarization, primary electromagnetic fields induce currents on said plate, said induced currents re-radiate secondary electromagnetic fields which cancel portions of said primary electromagnetic fields.

47. The antenna of claim 46 wherein said apertures are substantially square.

48. The antenna of claim 46 further comprising printed circuit board baluns, one of said baluns being adhesively bonded to each of said dipoles.

49. The antenna of claim 48 wherein said printed circuit board baluns are generally shaped like an inverted U.

50. The antenna of claim 48 wherein each of said dipole pairs is formed from metal plates attached to said backplane so said plates are generally orthogonal to said surface of said backplane, one of said printed circuit board baluns being laminated to each of said dipoles.

51. The antenna of claim 46 wherein each of said dipoles is comprised of two half dipoles each having a base, said half dipoles being connected at said base.

52. The antenna of claim 46 wherein said dipole pairs are attached to said backplane by fasteners selected from the group consisting of screws, bolts, rivets, and straps.

53. The antenna of claim 46 wherein said dipoles comprise two half dipoles, each of said half dipoles having a generally ax-like profile.

54. The antenna of claim 46 further including a plurality of conductive elements extending through said backplane for connecting said feed network to said dipole elements.

55. The antenna of claim 46 further including a plurality of generally Z-shaped connectors that allow for tolerance buildup between said dipoles, said backplane and said feed network, said connectors connecting said dipoles through said backplane to said feed network.

56. The antenna of claim 46 whereby said first predetermined angle is substantially equal to +45 degrees with respect to said vertical axis and said second predetermined angle is substantially equal to −45 degrees with respect to said vertical axis.

57. The antenna of claim 46 wherein said plate is composed of aluminum.

58. The antenna of claim 46 wherein said feed network is attached to said backplane by plastic rivets.

59. The antenna of claim 46 further comprising sidewalls attached to said backplane for narrowing the 3 dB beamwidth of said antenna.

60. The antenna of claim 46 further comprising substantially L-shaped sidewalls attached to said backplane.

61. The antenna of claim 46 further comprising a radome having integral guide rails that secure said radome to said antenna.

62. The antenna of claim 46 wherein said backplane is a ground plane composed of metal.

63. A dual polarized antenna for transmitting and receiving electromagnetic signals comprising:

a backplane having a length and a vertical axis along said length;

a plurality of dipole radiating elements projecting outwardly from a surface of said backplane, each of said elements including a balanced orthogonal pair of dual polarized dipoles aligned at first and second predetermined angles with respect to said vertical axis, forming crossed dipole pairs, each of said dipole pairs being formed from metal plates attached to said backplane so said plates are generally orthogonal to said surface of said backplane;

an unbalanced feed network extending along said backplane and connected to said radiating elements; and a plurality of printed circuit board baluns, one of said baluns being bonded to each of said dipoles.

* * * * *